US005683242A

United States Patent [19]

Cronin et al.

[11] Patent Number: 5,683,242

[45] Date of Patent: Nov. 4, 1997

[54] OVEN WITH TEMPERATURE BALANCING

[75] Inventors: John V. Cronin, Newport Beach; Peter R. Rose, Tustin; Mark A. Stroud, Whittier; David M. Koistinen, Santa Ana, all of Calif.

[73] Assignee: Circuit Automation, Inc., Fountain Valley, Calif.

[21] Appl. No.: 352,514

[22] Filed: Dec. 9, 1994

[51] Int. Cl.[6] ..... F27B 9/02

[52] U.S. Cl. ..... 432/144; 432/72; 432/199; 432/152

[58] Field of Search ..... 432/37, 120, 121, 432/176, 199, 200, 8, 72, 59, 143, 144, 145, 148, 149, 152.

[56] References Cited

U.S. PATENT DOCUMENTS 4,308,853 1/1982 Thirode ..... 219/391

5,233,763 8/1993 Minnie, Jr. ..... 432/72

*Primary Examiner*—Henry A. Bennett

*Assistant Examiner*—Gregory Wilson

*Attorney, Agent, or Firm*—G. Donald Weber, Jr.

[57] ABSTRACT

An oven for electronics manufacturing including a heated chamber having openings at each end to the ambient environment wherein heated air is circulated by a centrally located fan to pass over workpieces in a substantially upward (or downward) flow. Equal temperatures at the entrance and exit ends of the heated chamber are promoted by a crossover air return arrangement in which a portion of the air from each end of the heated chamber is mixed with the air from the other end of the chamber as the circulating air is drawn into the fan for recirculation. In addition, a moveable shutter mechanism is provided at the entrance end and exit end of the heated chamber to adjust the air flow at the ends of the heated chamber. The shutter mechanism operates to selectively close off an adjustable portion of the heated air flow at the ends of the heated chamber. A closed loop control system maintains equal temperatures and air flow at the opposite ends of the heated chamber by periodically adjusting the shutter mechanism position in response to the measured temperatures of the air immediately outside the entrance and exit ends of the heated chamber.

22 Claims, 4 Drawing Sheets

OVEN WITH TEMPERATURE BALANCING

BACKGROUND

1. Field of the Invention

The present invention relates to ovens for use in electronics manufacturing and in particular to providing uniform air flow and uniform temperatures to workpieces in said ovens. The invention relates especially to compensating for the effects of the presence of the workpieces in the oven and the effects of the environment external to the oven in providing uniform processes in said ovens.

2. Prior Art

Ovens are used in the electronics manufacturing industry for, among other uses, drying or curing work products at various stages in the manufacturing process. Large conveyorized ovens are used effectively to improve productivity, decrease variability, and increase yield in processes such as tack-drying for final cure of solder mask and legend ink processes.

These electronics manufacturing processes require that each workpiece be subjected to identical conditions in the heated chamber. High temperatures such as up to 400 degrees Fahrenheit may also be required. In the case of larger ovens, which provide the best productivity, maintenance of the required temperature and air flow throughout the heated chamber is often difficult. In order to ensure compliance with manufacturing specifications and provide a uniform process for each workpiece, the heated chamber should not have hot or cold spots or areas of poor air circulation.

Although an oven may have even air flow and temperature uniformity throughout when empty, the presence of workpieces in the oven will alter the nominal air flow pattern and may produce disparate temperatures and zones of poor air circulation. For example, the flow of heated air may be directed from side-to-side, from top-to-bottom, or from bottom-to-top in large high temperature ovens. The workpieces, such as the large panels that are frequently the subject of the drying or curing processes, although mounted on a rack or conveyor in a nominally upright position in the heated chamber, are commonly tilted at an angle of 5 to 15 degrees. The presence of these tilted panels may alter the air flow pattern of the chamber.

The distorted air flow pattern may produce hot or cold spots or may produce a pressure differential between one end of the heated chamber and the other end. This pressure differential may result in different conditions at the opposite ends of the heated chamber such as, for example, ambient outside air being drawn in one end of the chamber and heated air being exhausted from the other end of the chamber or differing amounts of ambient air being drawn into the opposite ends. This may further disturb the temperature throughout chamber from the desired temperature profile. The end of the chamber receiving the greater ambient outside air may have a lower temperature than the other end of the chamber. Conditions in the ambient environment, such as exposure of one end of the oven to a draft from outside the oven, may also effect the uniformity of air flow and temperature profile in the oven. The resulting uneven heating and air flow may have deleterious effects on the processing being performed, especially when precise process control is necessary.

SUMMARY OF THE INVENTION

It is therefore an object of the present invention to provide an oven in which each workpiece is subjected to identical conditions throughout the heated chamber.

Another object of the present invention to provide an oven in which air flow over each workpiece is uniform throughout the heated chamber.

Yet another object is to provide an oven in which each workpiece is subject to an identical temperature throughout the heated chamber.

Another object of the present invention to provide an adjustment to compensate for the effect of the workpieces on the air flow in the oven and consequently maintain the required temperature uniformity for each workpiece in the heated chamber.

A further object is to compensate for the effects that the ambient outside air circulation may have on the temperature uniformity within the chamber.

Briefly, an oven with temperature balancing according to the present invention includes a heated chamber in which the heated air is circulated (recirculated) by a centrally located fan to pass over the workpieces in a substantially upward (or downward) flow. In a first aspect of temperature balancing, equal temperatures at the entrance and exit ends of the heated chamber are promoted by a crossover air return arrangement in which a portion of the air from each end of the heated chamber is mixed with the air from the other end of the chamber as the circulating air is drawn into the fan for recirculation. A pair of J-shaped ducts are disposed to allow the fan to draw air from each end of the chamber through the ducts to be mixed with air being drawn directly into the fan from the other end of the chamber.

In a second aspect, a moveable shutter mechanism is provided at the entrance end and exit end of the heated chamber to adjust the upward (or downward) air flow at the ends of the heated chamber. The shutter mechanism operates to selectively close off an adjustable portion of the heated air flow at the ends of the heated chamber. A closed loop control system maintains equal temperatures and air flow at the opposite ends of the heated chamber by periodically adjusting the shutter mechanism position in response to the measured temperatures of the air immediately outside the entrance and exit ends of the heated chamber (or in response to another measured parameter such as the rate of the air flow into or out of the heated chamber).

Other advantages, and features of the present invention will become apparent from the following detailed description of the preferred embodiment of the invention when considered in conjunction with the accompanying drawings, wherein like reference characters represent like parts throughout the several views and wherein:

DESCRIPTION OF THE PREFERRED EMBODIMENT

Figure 1:
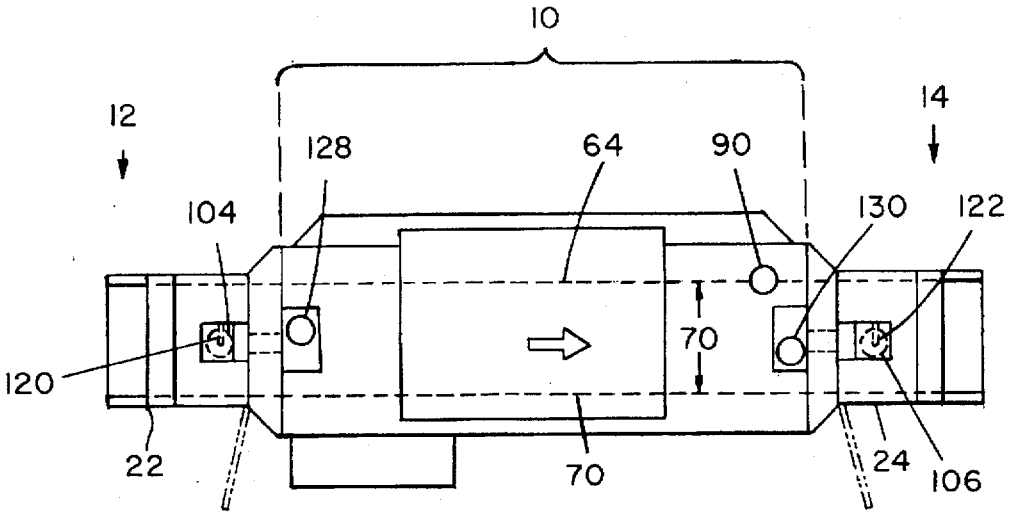
FIG. 1 is a plan view of a conveyorized oven incorporating temperature balancing as contemplated by the present invention.
Figure 2:
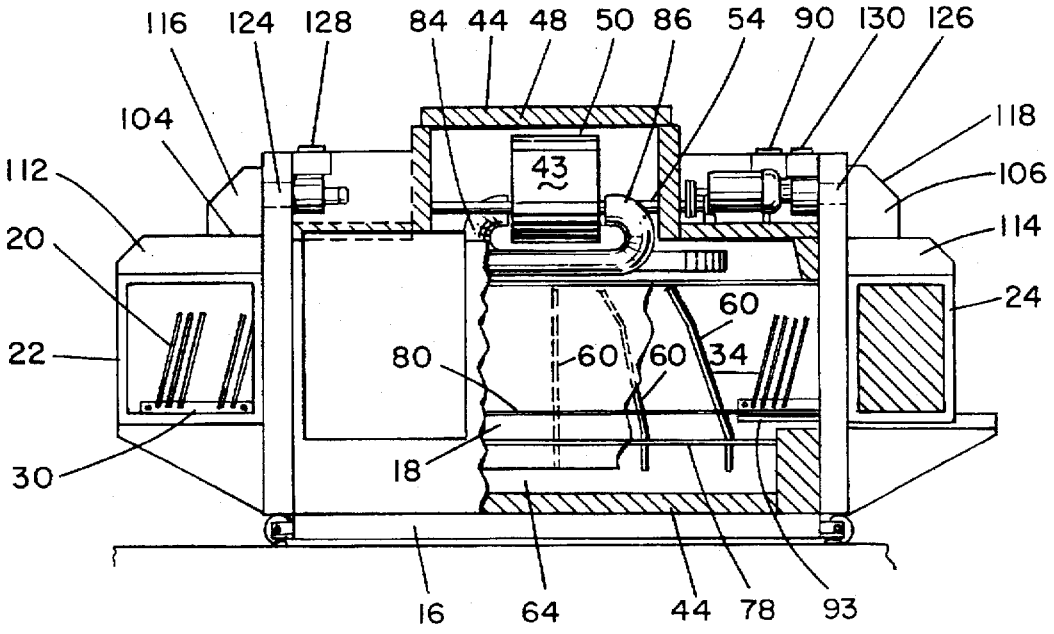
FIG. 2 is a partially cutaway, side elevation view of the oven of FIG. 1.

Referring now to the drawings, and in particular to FIGS. 1 and 2, the preferred embodiment of the present invention is illustrated by a conveyorized oven having a central heated chamber 10 and entrance and exit sections, 12 and 14, respectively. The heated chamber 10 rests on a supporting frame 16. A conveyor 18 extends the length of the oven for transporting workpieces such as panels 20 e.g. printed circuit boards into and out of the heated chamber 10. The entrance section 12 and the exit section 14 are provided with side doors 22 and 24, respectively, to facilitate the loading and unloading of the panels onto the conveyor 18.

Figure 4:
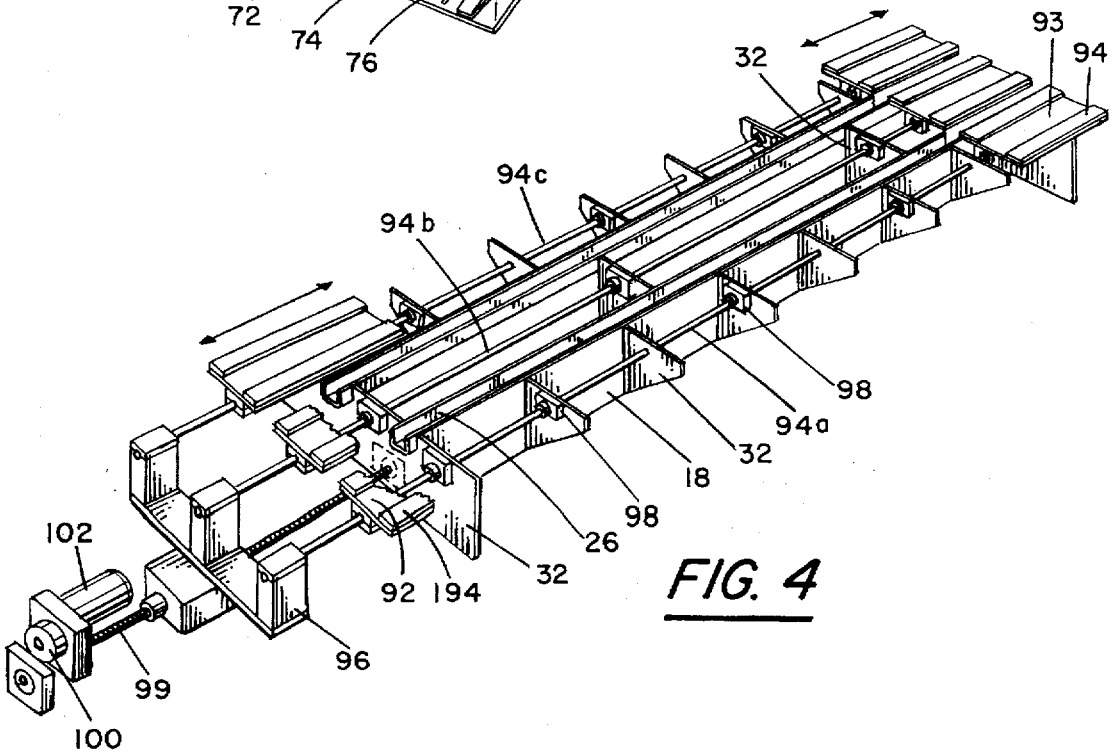
FIG. 4 is an isolated, partially pictorial, partially schematic view illustrating the temperature balancing shutter of the present invention.

As best seen in FIG. 2 in conjunction with FIG. 4, the conveyor 18, which is disposed at a height which is convenient for loading or unloading the panels 20, includes two narrow, parallel, horizontal chainway members disposed the length of the oven. The entire length of the chainway members are not shown in FIG. 4 to limit the complexity of the drawings. Each parallel chainway member has an upper channel or chainway 26 and a lower channel or chain return 28 (not shown) located below the related chainway 26 for retaining a continuous chain (not shown) in a chain loop. The panels 20 are transported into the heated chamber 10 on a conveyer rack 30. The conveyor 18 is preferably adapted to be driven by an electric motor (not shown) or other suitable drive mechanism. The conveyor 18, including the rack 30 and any structure for supporting the conveyor in the oven such as transverse support brackets 32, should be designed to minimize any disruption of the flow of air in the heated chamber 10.

Figure 3:
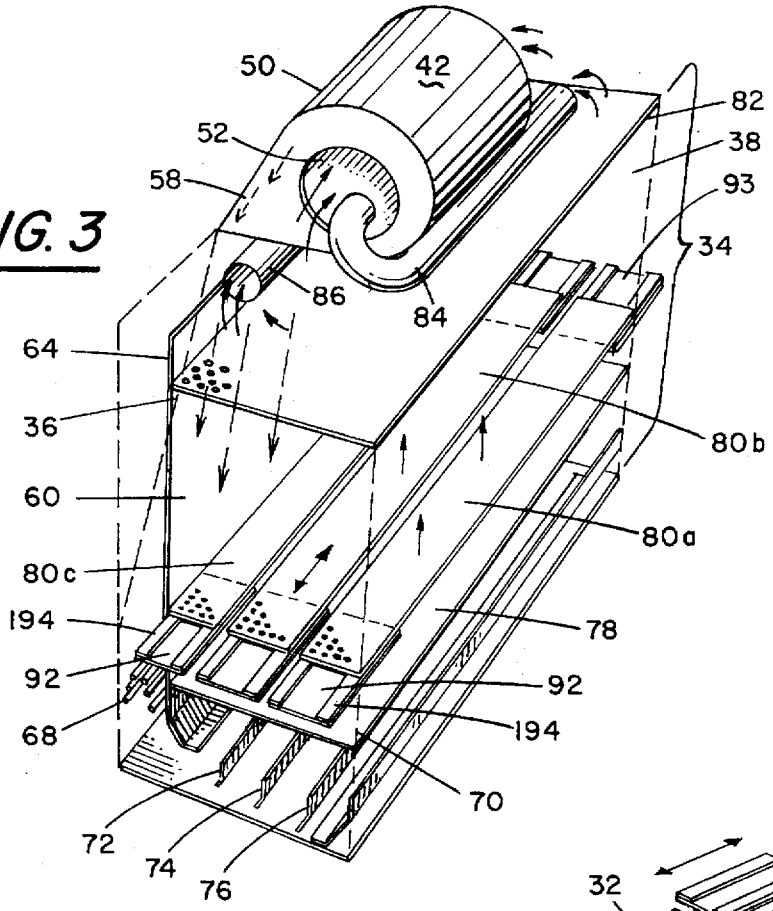
FIG. 3 is a cutaway, partially pictorial, partially schematic drawing illustrating the interior structure and air circulation of the oven.

The heated chamber 10, as best illustrated in FIGS. 2 and 3, is of generally rectangular cross section that has entrance and exit openings 36 and 38, respectively, of height H and width W, respectively, through which the conveyor 18 transports the workpieces 20 to the interior of the chamber. The heated chamber 10 is adapted to house a centrifugal fan 42 which is centrally disposed above the conveyor 18 at the top of the chamber. The exterior walls 44 of the heated chamber 10 are each constructed of a thick layer of insulating material 46 within a sheet metal frame 48 to provide well-insulated heat containment walls.

The centrifugal fan 42 has a scroll 50 with converging apertures 52 on each end communicating with the interior of the scroll. A squirrel cage impeller (not shown) is disposed in the interior of the scroll 50 and is driven via drive shaft 54 by motor 56. The fan 42 has an outlet (not shown) at its rear by which air from the interior of the scroll is delivered via a duct 58 into a manifold 60 which in turn delivers the air (as indicated by the dashed arrows in FIG. 3) to the base of the heated chamber 10 along the length of the chamber.

The manifold 60, which is formed between the back wall 62 and a longitudinal interior wall 64, distributes the air from the fan 42 over the length of the heated chamber 10 at the base 10 thereof. A plurality of heating elements 68 are disposed longitudinally at the base of the manifold 60 so that the air from the fan 42 passes over the heating elements as it exits the manifold.

As shown in FIG. 3, the fan 42 circulates (and recirculates) the air in the heated chamber 10. The fan 42 operates to draw the air in the heated chamber 10 upward into the scroll 50, to then blow the air downward through the duct 58 and the manifold 60. The interior wall 64 and the front wall 70 of the chamber 10 define the sides of an interior chamber where the heating/drying of the workpieces 20 occurs and where the precise control of temperature and air flow is desired. As the heated air exits from the manifold 60 in a generally horizontal direction along the base of the interior wall 64, it is directed upward by longitudinal louvers 72, 74 and 76 disposed at the base of the interior chamber.

The air from the manifold 60 is next directed though two thin horizontal perforated metallic layers 78 and 80 in the circulation/recirculation path. The horizontal perforated screen 78 is disposed above the manifold outlet and below the conveyor 18 and extends for the entire length and width of the internal chamber. The second horizontal perforated layer 80 extends the length and width of the internal chamber at the level of the conveyor 18. This second perforated layer is made of three parallel longitudinal metallic sheets or screens **80*a*, 80*b*, and 80*c* which are disposed between and on each side of the chainways of the conveyor 18**. It is noted that the chainways are not shown in FIG. 3 to eliminate unnecessary complexity.

A third horizontal perforated metallic sheet 82 is located above the area where the workpieces are positioned and extends the length and width of the internal chamber.

The air flows upwardly from the base of the internal chamber through the first perforated screen 78, through the second perforated screen 80, and through the third perforated screen 82 to be recirculated into the fan 42. The return air flow to the fan 42 is provided via a direct path from the interior chamber to the converging apertures 52 of the fan scroll 50 and also by a cross-over arrangement which returns a portion of the heated air from each end of the interior chamber to the converging aperture 52 at the opposite end of the chamber. This cross-over arrangement mixes the air from the two ends of the chamber in the fan 42 to counteract any temperature variation that may be present through out the chamber and to promote the uniform temperature of the recirculated air. For this purpose, a pair of horizontal J-shaped, longitudinal ducts 84 and 86 extend in opposite directions above the perforated sheet 82 and have one end turning 180 degrees toward a converging aperture 52 and the other end directed toward the end of the oven away from that particular converging aperture.

The J-shaped ducts 84 and 86 are disposed just below the fan 42 and extend horizontally toward the ends of the chamber 10. The upward air flow within the chamber forms a wall-like boundary of hot air adjacent the entrance and exit openings that tends to inhibit outside air from entering the chamber. The ducts 84 and 86 also allow the fan 42 to disrupt these hot air boundaries and to thereby permit some outside air to be drawn into the chamber.

As shown in FIG. 2, an exhaust opening 88 is provided on the longitudinal center line of the internal chamber midway between the entrance section 12 and the centrifugal fan 42 to allow a portion of the air in the heated chamber 10 to be exhausted from the heated chamber. A first exhaust fan 89 draws air from the interior of the heated chamber 10 through the exhaust opening 88 to provide a controlled exhaust of the air through a vertical exhaust duct 90.

Referring now to FIGS. 3 and 4, a movable shutter mechanism is disposed at each end of the interior chamber to adjust the air flow at the ends of the heated chamber 10 (more precisely the ends of the interior chamber). In the preferred embodiment illustrated, the shutter mechanism includes three (3) metallic shutters 92 at the entrance end and three metallic shutters 93 at the exit end (for a total of six shutters) which are, conveniently, slidably mounted immediately below the second perforated layer 80. Each shutter 92 includes two (2) longitudinal strips of Teflon bearing material 194 to facilitate the sliding movement of the shutters against the lower surface of the second perforated layer 80. The shutters 92 and 93 are movable in order to selectively obstruct an adjustable portion of the upward air flow at the ends of the heated chamber 10.

As shown in FIG. 4, the shutters 92 and 93 are mounted on three longitudinal rods 94*a*, 94*b* and 94*c* with a shutter disposed on each end of each rod 94*a*, 94*b*, 94*c*. One end of each rod 94*a*, 94*b* and 94*c* is mounted on a yoke 96 that is disposed in the entrance section 12. The rods 94*a*, 94*b*, and 94*c* which support the shutters are mounted in bearing blocks 98 that are supported by the transverse brackets 32 which also support the conveyor 18. The yoke 96 is driven in a longitudinal direction by a ball screw 99 that is driven via a chain and sprocket combination 100 by a motor 102.

In the preferred embodiment, the shutters 92 and 93 at the opposite ends of the heated chamber 10 are rigidly connected together by the rods 94 such that the shutters move together and in the same direction in response to longitudinal movement by the yoke 96 under the control of the motor 102. FIG. 3 illustrates the shutters 92 and 93 of the preferred embodiment in the preferred neutral position (i.e., the shutter position where the relative shutter positions are identical at each end) wherein one half of the each shutter 92 and 93 extends into the heated chamber 10. In this arrangement, when the shutters 92 at the entrance end of the heated chamber 10, for example, are moved to a position that obstructs a larger area of the air flow in the interior chamber at the entrance end, the shutters 93 at the exit end of the heated chamber will be correspondingly be moved to a position that obstructs a smaller area of the inner chamber at that end. Each shutter travels between its open position wherein the shutter is completely withdrawn from the interior chamber and its more closed position wherein the entire shutter is disposed in the heated chamber.

It will be recognized that, alternatively, the shutters 92 and 93 at each end of the heated chamber 10 can be independently controlled simply by using separate mounting rods and a separate drive mechanism for each end of the heated chamber.

Figure 5:
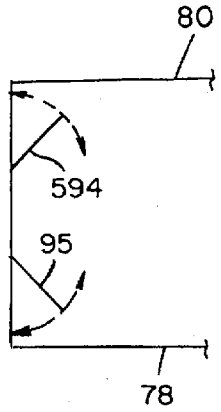
FIG. 5 is a schematic view illustrating an alternative temperature balancing shutter.

It also will be recognized that the linear motion of the shutters 92 and 93 of the preferred embodiment may be replaced by a shutter which rotates on a horizontal transverse axis at the end of the chamber between a vertical position in which the upward air flow is not impeded at all, and a horizontal position in which the airflow is blocked to the maximum extent possible by the shutter, to any position between these two extremes. In two implementations of this alternative, as illustrated in FIG. 5, a rotating shutters 94 or 95 would preferably be located below the perforated screen 80. Alternatives relating to the selection of joint reciprocating movement or independently controlled movement for the rotating shutter are the analogous to those described in connection with the linear shutter movement of the preferred embodiment.

Referring again to FIGS. 1 and 2, the entrance section 12 and the exit section 14 are each provided with an exhaust opening 104 and 106, respectively, centrally located in the hood 112 and 114 of each section. Each exhaust opening 104 and 106 communicates with a temperature monitoring chamber 116 and 118 in which a thermocouple 120 and 122 is disposed to measure the temperature of air in the entrance section 12 and exit section 14. Each temperature monitoring chamber 116 and 118 is coupled to a fan 124 and 126, respectively, which pulls air from the respective temperature chamber into an exhaust duct 128 and 130, respectively. The thermocouples 120 and 122 are disposed preferably in the exhaust openings 104 and 106 between the hoods and the temperature monitoring chambers. The temperatures measured in the temperature monitoring chambers 116 and 118 are used as an indicator of the air flow through the ends of the chamber and, therefore, as a basis for controlling the position of the shutters 92 and 93. It will be recognized that the thermocouples may be positioned at other places within the entrance and exit sections 12 and 14 within the concept of the present invention.

It is noted that other parameters indicative of the temperature or air flow conditions at the ends of the heated chamber, such as the air flow rates into and/or out of the heated chamber, may be measured and used as a basis for controlling the position of the shuttles.

Figure 6:
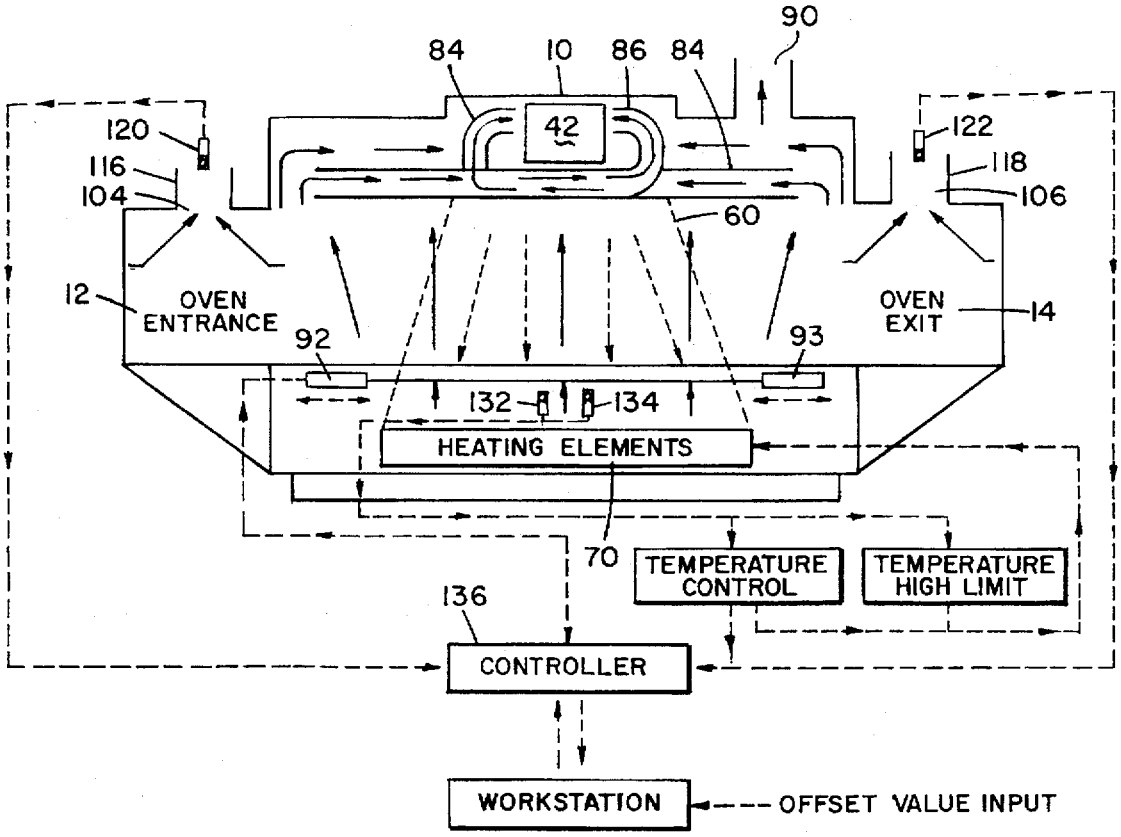
FIG. 6 is a schematic drawing useful in understanding the operation of the temperature balancing oven of the present invention.

The operation of the oven with temperature balancing according to the present invention will now be described with reference to FIGS. 6 and 7. The air in the heated chamber 10 flows upward and into centrifugal fan 42 directly from the interior chamber and also via the crossover ducts 84 and 86 as indicated by the solid arrows in FIG. 6. The fan 42 then directs the air downward via manifold 60 to the base of the heated chamber as represented by the dashed arrows. The air flows by the heating elements 70 and flows upward again to be recirculated through the chamber by the centrifugal fan 42.

Two thermocoupler 132 and 134 are disposed centrally within the heated chamber 10 to measure the temperature within the heated chamber and are coupled, as represented by dashed lines 135 for use by a program logic controller 136 in controlling the operation of the oven. The temperature measured by thermocouple 132 is used in a control loop which adjusts the heating provided by the heating elements 70 to maintain the temperature at the thermocouple 132 according to a programmed temperature or temperature profile. The temperature measured by the thermocouple 134 is used by the program logic controller to provide a high temperature safety limit to prevent overheating of the oven beyond a high temperature limit.

Figure 7:
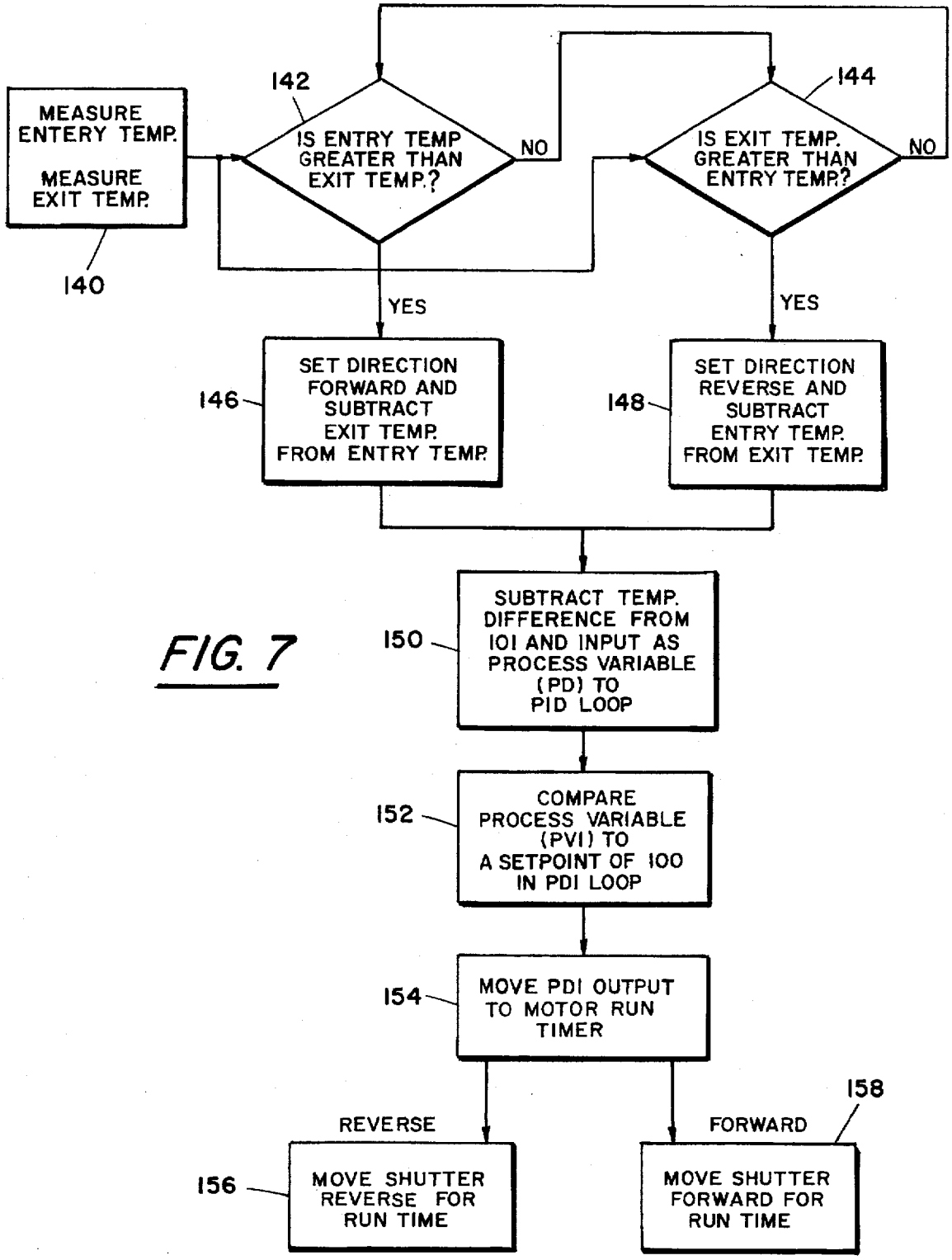
FIG. 7 is a flow diagram illustrating a process for controlling the temperature balancing shutter of the present invention.

Referring now to FIG. 7, the program logic controller 136 implements a shutter control loop for balancing the temperatures (or perhaps providing a specific unequal temperature profile) at the ends of the heated chamber. As indicated by block 140, the program logic controller 136 reads the temperatures in the entrance and exit hoods 116 and 118 via thermocouples 120 and 122, respectively, and determines which temperature is greater in blocks 142 and 144.

The controller 136 determines the temperature difference and selects 1) to move the shutters forward (that is, toward the exit end of the oven or in effect to increase the effect of the entrance shutter 92 and decrease the effect of the exit shutter 93) if the entrance temperature is greater, or 2) to move the shutters toward the entrance end of the oven if the exit temperature is greater as shown in blocks 146 and 148. The temperature difference is, as represented in block 150, input as a process variable in the control loop and compared to a set point in the control loop at block 152. Based on this comparison with the set point, the program logic controller 136 determines (in block 154) the appropriate time to run the shutter drive motor 102 in the direction set in block 146 or 148. As indicated by blocks 156 and 158, the program logic controller operates the drive motor 102 in the appropriate direction for the selected period of time to position the shutters 92 and 93 in the desired position.

The foregoing shutter control process is periodically repeated to maintain the appropriate temperature profile. In the preferred embodiment, the control loop is initiated every second; therefore, the temperatures are evaluated every second and the shutters positioned accordingly in order to provide precise control of the temperature and air flow in the oven.

It is further noted that while the present invention has been specifically described with regard to an oven in which the heated air flows from bottom to top when traversing the region where the workpieces are positioned, the temperature balancing principles are equally applicable to an oven in which the heated air flows from the top of the heated chamber to the bottom or side to side with the appropriate rearranging of the oven elements to accommodate the direction of flow and to accomplish the required uniformity of the heated air.

While the preceding description has been directed to particular embodiments, it is understood that those skilled in the art may conceive modifications and/or variations to the specific embodiments and described herein. Any such modifications or variations which fall within the preview of this description are intended to be included therein as well. It is understood that the description herein is intended to be illustrative only and is not intended to limit the scope of the invention. Rather, the scope of the invention described herein is limited only by the claims appended hereto.

We claim:

1. An oven comprising, chamber means having a first end and a second end, circulation means for causing heated air to be circulated within said chamber means, said chamber means having a first opening to the ambient environment at said first end and a second opening to the ambient environment at said second end, means for controlling the air circulation in said chamber means in order to compensate for the effects of said ambient outside environment on said heated air in said chamber means, said means for controlling the air circulation in said chamber means includes means for mixing a portion of heated air at each said first and second end of said chamber means with the heated air at the other of said first and second end of said chamber means, said means for controlling the air circulation includes first shutter means positioned in the path of a portion of the heated air at at least one end of said chamber means and second shutter means positioned in the path of a portion of the heated air at said second end of said chamber means, said means for controlling the air circulation includes:

measurement means for measuring a physical parameter of the ambient environment at each end of said chamber means;

means for moving at least one of said first and second shutter means to produce a predetermined relationship between the measured physical parameter of the ambient environment at each end of said chamber means.

2. The oven recited in claim 1 wherein, said means for mixing includes tubular means to return a portion of the heated air from each end of the chamber means to the other end of the chamber means.

3. The oven recited in claim 1 wherein, said measurement means comprises means for measuring the temperature of the ambient environment at each end of said chamber means.

4. The oven recited in claim 1 wherein, said shutter means comprises a pivotable shutter means.

5. An oven comprising, a chamber wherein heated air is circulated, said chamber having a first opening to the ambient environment at a first end thereof and a second opening to the ambient environment at a second end thereof, means for measuring a physical parameter of the ambient environment at each end of said chamber; and means for adjusting the air circulation in at least one end of said chamber to compensate for the effects of said ambient environment on said heated air in the chamber, said means for adjusting including shutter means positioned adjacent at least one end of the chamber and operative to control the flow of said heated air which is circulated in said chamber, and means for moving said shutter means connected to said means for measuring in order to produce a predetermined relationship between the measured physical parameter of the ambient environment at each end of said chamber by controlling the flow of said heated air.

6. The oven recited in claim 5 wherein, said means for measuring a physical parameter comprises means for measuring the temperature of the ambient environment at each end of the oven.

7. An oven comprising, a heating chamber having first and second ends, measuring means at at least one of said first and second ends, said measuring means operative to measure at least one of the parameters of temperature and air flow at the respective ends;

air flow control means disposed adjacent said respective end, and control means connected to said measuring means and to said air flow control means so that said air flow control means is manipulated in response to the parameter measurement by said measuring means.

8. The oven recited in claim 7 wherein, said measuring means comprises at least one thermocouple.

9. An oven comprising, a heating chamber having first and second ends, air moving means mounted at said heating chamber, air flow control means mounted in said heating chamber to control the air flow caused in said heating chamber by said air moving means, controller means connected to said air flow control means to control the operation thereof as a function of air flow at at least one of said first and second ends of said heating chamber.

10. The oven recited in claim 9 wherein, said air moving means includes fan means for moving air within said heating chamber.

11. The oven recited in claim 9 including, heating means for heating air within said chamber.

12. The oven recited in claim 9 wherein, said air flow control means includes ducts mounted in said heating chamber to conduct air from each of said first and second ends to said air moving means.

13. The oven recited in claim 9 wherein, said air flow control means includes movable shutter means adjacent at least one of said first and second ends.

14. The oven recited in claim 9 wherein, said controller means includes:

temperature measuring means at each of said first and second ends, comparison means connected to said temperature measuring means to detect any temperature differential between the temperatures at said first and second ends, and drive means connected to adjust said air flow control means as a function of said temperature differential detected by said comparison means.

15. An oven comprising, chamber means having first and second ends, said chamber means having first and second openings to the ambient environment at said first and second ends, respectively, and circulation means for causing heated air to be circulated within said chamber means, means for controlling the air circulation in said chamber means in order to compensate for the effects of said ambient outside environment on said heated air in said chamber means, said means for controlling the air circulation in said chamber means includes means for mixing a portion of heated air at each of said first and second ends of said chamber means with the heated air at the other one of said first and second ends of said chamber means, said means for controlling the air circulation includes first and second shutter means positioned in the path of a portion of the heated air at said first and second ends, respectively, of said chamber means, and at least one of said first and second shutter means comprises a slidable shutter means.

16. The oven recited in claim 5 wherein, said shutter means is disposed entirely within said chamber.

17. The oven recited in claim 9 including, conveyor means extending generally longitudinally through said chamber.

18. The oven recited in claim 17 wherein, said conveyor means includes a continuous chain.

19. The oven recited in claim 9 wherein, said air moving means comprises a fan.

20. The oven recited in claim 9 wherein, said air flow control means includes manifold means for distributing air from said air moving means throughout said heating chamber.

21. The oven recited in claim 7 wherein, said controller means includes:

comparison means for determining the relative temperature at said first and second ends of said chamber, and drive means for manipulating said air flow control means as a function of the relative temperature.

22. An oven comprising, chamber means having a first end and a second end, said chamber means having a first opening to the ambient environment at said first end and a second opening to the ambient environment at said second end, means for controlling the air circulation in said chamber means in order to negate the effects of said ambient outside environment on said heated air in said chamber means and to maintain a uniform temperature within said chamber means, means for mixing together a portion of the heated air within said chamber means from each of said first and second ends of said chamber means and supplying the mixed air to said circulation means, and temperature measurement means for measuring the air temperature at each end of said chamber means.

* * * * *